United States Patent [19]

Harvey, II et al.

[11] 4,106,928

[45] Aug. 15, 1978

[54] CHLORINATION PROCESS FOR PRODUCING ALUMINUM

[75] Inventors: Francis J. Harvey, II, Murrysville; Maurice G. Fey, Plum Borough, both of Pa.

[73] Assignee: Westinghouse Electric Corp., Pittsburgh, Pa.

[21] Appl. No.: 773,457

[22] Filed: Mar. 2, 1977

Related U.S. Application Data

[63] Continuation-in-part of Ser. No. 666,812, Mar. 15, 1976, abandoned.

[51] Int. Cl.[2] ..... C22B 21/02

[52] U.S. Cl. ..... 75/68 B; 75/68 R

[58] Field of Search ..... 75/68 R, 68 B

[56] References Cited

U.S. PATENT DOCUMENTS

| | | | |
|---|---|---|---|
| 3,078,159 | 2/1963 | Hollingshead | 75/68 B |
| 3,615,359 | 10/1971 | Toth | 75/68 R |
| 3,615,360 | 10/1971 | Harris | 75/68 R |
| 3,713,809 | 1/1973 | Toth | 75/68 R |
| 3,713,811 | 1/1973 | Toth | 75/68 R |
| 3,853,541 | 12/1974 | Othmer | 75/68 B |
| 3,900,312 | 8/1975 | Terry | 75/68 B |
| 3,918,960 | 11/1975 | Toth | 75/68 R |

*Primary Examiner*—P. D. Rosenberg
*Attorney, Agent, or Firm*—L. P. Johns

[57] ABSTRACT

A process for the production of aluminum characterized by the steps of chlorinating a material containing chemically combined aluminum and silicon with chlorine to produce aluminum trichloride and silicon tetrachloride, reacting aluminum trichloride with manganese to produce elemental aluminum and manganese chloride, reducing silicon tetrachloride to yield silicon, oxidizing the manganese chloride to produce manganese oxide, and reducing the manganese oxide with silicon to produce manganese which is recycled to the second step for reducing aluminum trichloride.

7 Claims, 1 Drawing Figure

SCHEMATIC REPRESENTATION OF PROCESS FOR PRODUCING ALUMINUM

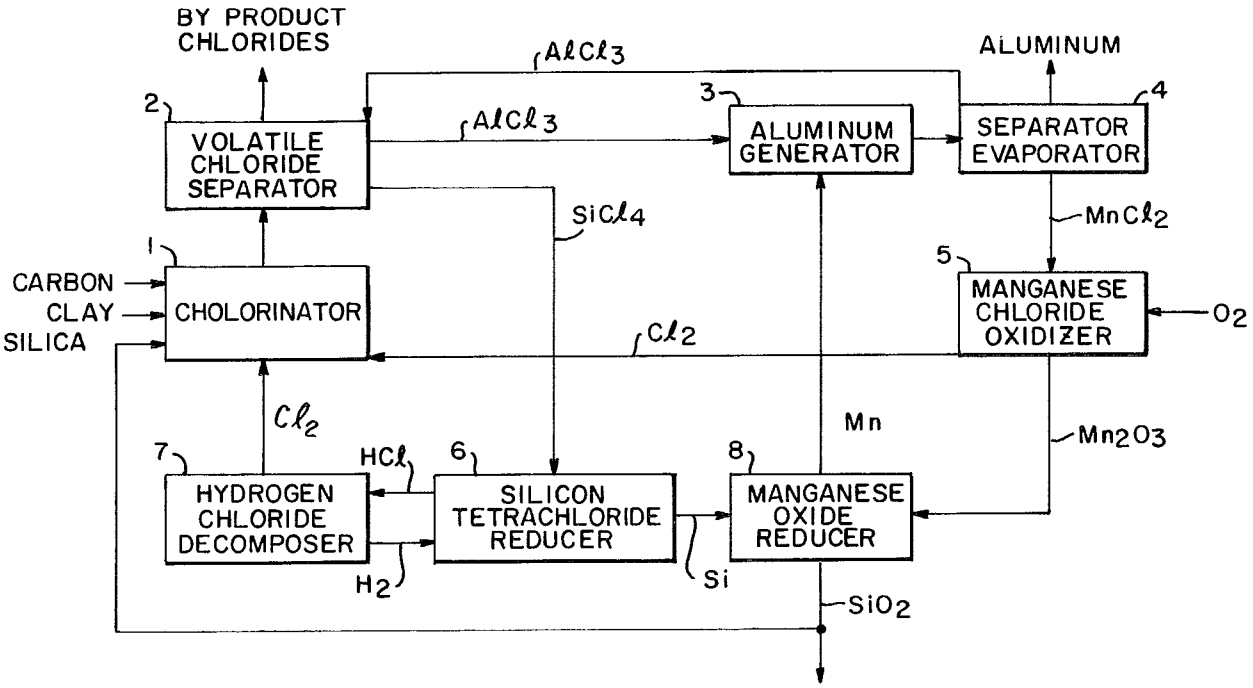
SCHEMATIC REPRESENTATION OF PROCESS FOR PRODUCING ALUMINUM

CHLORINATION PROCESS FOR PRODUCING ALUMINUM

This is a continuation-in-part application of application Ser. No. 666,812, filed Mar. 15, 1976, now abandoned.

BACKGROUND OF THE INVENTION

1. Field of the Invention

This invention relates to a process for producing aluminum from clay or other aluminum containing raw material.

2. Description of the Prior Art

There are a number of processes for producing aluminum including the Toth process and the Bayer-Hall process. The Toth process has advantages over the currently used Bayer-Hall process, including the ability to use low-grade bauxites, clays, or other aluminum containing ores. Such ores are much more plentiful and cheaper than the high-grade bauxite which is required for the Bayer-Hall process.

The Toth process (U.S. Pat. Nos. 3,615,359; 3,615,360; 3,713,809; and 3,713,811) consists of the following steps:

(a) Chlorination of a calcined clay mixed with coke in a mixture of chlorine and silicon tetrachloride, which is recirculated from step (b) and added to suppress the chlorination of silica in the clay, (b) Separation of volatile chlorides and carbon oxides produced in step (a) by a suitable series of fractional condensation and purification stages to yield a pure liquid aluminum trichloride and by product chloride of silicon, iron, titanium, etc., (c) Reduction of the aluminum trichloride by manganese metal to produce aluminum metal and a salt mixture of aluminum trichloride and manganese chloride, (d) Separation of the aluminum and salt mixture produced in step (c) and evaporation of the salt mixure to produce solid manganese chloride and aluminum chloride vapor which is condensed and returned to the aluminum generator, (e) Oxidation of the manganese chloride to produce manganese oxide and chlorine which is returned to step (a) and, (f) Reduction of manganese oxide to produce manganese metal in a conventional blast furnace.

The use of a blast furnace to produce manganese metal does not appear to be economically feasible. A minimum of 3 tons of manganese must be used for each ton of aluminum in the manganese reduction of aluminum trichloride, and regeneration of manganese in a blast furnace will require large quantities of coke. For example, 1.5 tons of coke is required per ton of manganese in the blast furnace of 75% ferromanganese. On this basis, 4.5 tons of coke would be required per ton of aluminum. Furthermore, the blast furnace product would also contain large quantities of manganese carbide ($Mn_3C_7$) which would not be as effective in reducing aluminum trichloride as would pure manganese. In addition, aluminum carbide ($Al_4C_3$) is more stable than manganese carbide ($Mn_3C_7$) so that carbon may be transferred to the aluminum during the manganese reduction step.

The major advantage of the Toth process is the use of clay which constitutes a major breakthrough in the production of aluminum. However, it has been found that unless extreme precautions are taken, the resulting aluminum is contaminated with undesirably large quantities of manganese as well as carbon which is also used in the Toth process. Indeed, carbon consumption in the process is 1000% greater than is used in the Bayer-Hall process.

SUMMARY OF THE INVENTION

The foregoing problems associated with the Toth process can be overcome by a silicon reduction of the manganese oxide product in step (e) of the Toth process as described above. In particular, the silicon tetrachloride produced during the chlorination process in step (a) and separated from the resultant product stream in step (b) is hydrogen reduced to produce liquid silicon and gaseous hydrogen chloride. This silicon is then used to reduce the manganese oxide thus overcoming the inherent problems of the Toth process associated with the blast furnace reduction of manganese oxide. The hydrogen chloride produced in the hydrogen reduction of silicon tetrachloride can be electrolytically decomposed to produce hydrogen and chlorine which can be recycled to the overall process as appropriate.

The advantage of the process of this invention is twofold. First, contamination of aluminum with carbon as well as of manganese with carbon is avoided. Second, silicon, chlorine, and manganese are recycled for employment at various other stages of the process, thereby providing a more economical overall process.

BRIEF DESCRIPTION OF THE DRAWING

The single FIGURE of the drawing is a block diagram of the process involved in this invention.

DESCRIPTION OF THE PREFERRED EMBODIMENT

The process of this invention is performed in the apparatus represented in the drawing which includes a chlorination reactor 1, a volatile chloride separator 2, an aluminum generator 3, a separator/evaporator 4, a manganese chloride oxidizer 5, a silicon tetrachloride reducer 6, a hydrogen chloride decomposer 7, and a manganese oxide reducer 8.

The disclosed process consists of the following steps which are schematically shown in the drawing:

(a) Chlorination of an alumina and silica-bearing starting material such as clay mixed with carbon and additional silica if required by overall mass balance in the presence of chlorine to produce gaseous aluminum trichloride, silicon tetrachloride, oxides of carbon, and other volatile chlorides. This step is carried out in a suitable reactor 1.

(b) Separation of the product gas stream of step (a) to produce pure liquid aluminum trichloride, silicon trichloride, and other byproducts. This separation is performed in the separator 2.

(c) Reduction of the aluminum trichloride by manganese metal in the generator 3 to produce aluminum metal and a salt mixture of aluminum trichloride and manganese chloride.

(d) Separation of the aluminum and salt mixture followed by evaporation of the salt mixture to yield solid manganese chloride and gaseous aluminum trichloride which is condensed and returned to the aluminum generator. This step is carried out in the separator/evaporator 4.

(e) Oxidation of the manganese chloride in the oxidizer 5, to produce manganese oxide and chlorine which is recycled to step (a).

(f) Reduction of the silicon tetrachloride of step (b) in hydrogen to produce liquid silicon and gaseous hydrogen chloride. This reaction is carried out in the silicon reducer 6.

(g) Electrolytic decomposition of the hydrogen chloride to produce hydrogen, which is recycled to step (f), and chlorine, which is returned to step (a). This decomposition is performed in the decomposer 7.

(h) Reduction of the manganese oxide produced in step (e) by silicon produced in step (f) to yield manganese metal which is returned to step (c) and silicon oxide, which may be returned to step (a) if required. This reduction is carried out in the reducer 8.

Steps (a) through (e) of the process of this invention constitute the basic steps of a prior known process, such as the Toth process, except that the chlorination (step a) is not carried out in a mixture of chlorine and silicon tetrachloride but only in the presence of chlorine. In addition, excess silicon may be required in the starting material depending on the composition of the clay in order to maintain an overall mass balance. The condition of temperature and pressure of the steps (a) through (f) are carried out in accordance with the corresponding steps of the Toth process.

The remaining steps of the disclosed process, i.e. steps (f) through (h), constitute improvements over the prior art Toth process. The reduction of silicon tetrachloride by hydrogen is given by the reaction (1)

$$SiCl_4 + 2H_2 \rightarrow Si + 4HCl \quad (1)$$

This reaction is thermodynamically favored at temperatures around 2000° K. For example, the standard free energy of formation for reaction (1) is approximately −9000 calories/mole of silicon. The theoretical energy requirement for the reaction is 2.83 kw.hr./lb. of Si, based on an initial reactant temperature of 298° K and a product exit temperature of 2000° K. Thermodynamic calculations also show that the electrolytic decomposition of gaseous hydrogen chloride requires 1.71 kw.hr./lb. of Si at 298° K. Furthermore, the silicon reduction of manganese sesquioxide ($Mn_2O_3$) is exothermic based on an initial reactant temperature of 298° K and a product exit temperature of 1600° K. Thus, theoretically no energy is required of this reduction. This silicon reduction step can be carried out in the temperature range between 1000° and 2000° K since the reaction is thermodynamically favored in this range.

The following example is illustrative of the present invention:

EXAMPLE

Calcined clay, or other aluminum containing ores, and a carbon source are introduced into a reactor together with a stoichometric amount of chlorine to produce a mixture of $AlCl_3$, $SiCl_4$, CO, and other metallic chlorides, depending upon the starting material. Excess silica may be added to this reactor and chlorinated to form silicon tetrachloride if required by the overall mass balance.

Inasmuch as the $AlCl_3$ and $SiCl_4$ are gaseous with the former having a higher boiling point of 710° C, the $AlCl_3$ is separated from the other metallic chloride by simple fractional distillation.

The resulting liquified $AlCl_3$ is reduced with molten manganese to form aluminum and manganese dichloride ($MnCl_2$).

The inlet temperature of manganese is 1500° K while all other reactants are at room temperature. On this basis, the overall reaction is exothermic with an enthalpy change of −14,172 cal/mole of $Al_2O_3$. The heat requirement for the overall process is 240,000 cal/gm-atom of aluminum, or 4.7 kW-hr./lb. of aluminum at 2000° K.

The exit temperature of aluminum is 1500° K, or just above the melting point of manganese.

The $SiCl_4$ which is separated from the $AlCl_3$ by fractional distillation is reduced in the presence of hydrogen gas to produce silicon and hydrogen chloride. If an arc heater is used for the $SiCl_4$ reduction, the electrical energy requirements are about 2.7 kW-hr./lb. of aluminum. The hydrogen used for this reaction may be recycled hydrogen obtained from decomposition of hydrogen chloride.

The hydrogen chloride decomposition occurs at about one volt at room temperature. The mass balance considerations indicate that 0.215 lbs. of $H_2$ per lb. of aluminum are required from the overall process. On the basis of Faraday's constant, i.e., 96,500 amp-sec/gram equivalent weight, and the decomposition voltage of HCl, this process requires 2.6 kW-hr./lb. of aluminum.

Manganese used for the reduction of $AlCl_3$ may be recovered from the manganese dichloride produced in that reaction. For that purpose $MnCl_2$ is reacted with oxygen to produce manganese oxide ($MnO_2$) and chlorine gas, the latter of which together with the chlorine produced by the decomposition of HCl is recycled for the chlorination reaction. The exit temperature of the $MnO_2$ is 1000° K.

Finally, the manganese oxide is reduced by silicon to provide silicon dioxide ($SiO_2$) and elemental manganese which is recycled for the reduction of $AlCl_3$. The standard free energy change for the reaction between manganese dioxide and silicon is −21,519 cal/g-atom of manganese at 2000° K and does not change appreciably in the range between 1000° K. The manganese reduction is exothermic, thus no heat is required. The choice of temperature for this process is a compromise between the temperature dependent rate constant and the volatility of manganese which boils at 2314° K. This process is carried out in any convenient reactor such as a fluidized bed. The silicon dioxide is then recycled to the chlorinator and subsequently hydrogen is reduced.

In another embodiment, silicon tetrachloride is reacted with oxygen to produce silicon dioxide and chlorine, which can be recycled. Thereafter, the silicon dioxide is reduced by carbon to yield silicon and carbon monoxide. The silicon obtained in the last reaction is usable to reduce manganese dioxide to elemental manganese and silicon dioxide. Although small amounts of carbon are retained in the elemental silicon, the procedure of this embodiment has the advantage in that no hydrogen chloride is produced which is, in turn, electrolytically decomposed.

In conclusion, this process has numerous advantages over the currently used Bayer-Hall process including (1) the use of cheap and readily available raw materials rather than high-grade bauxite, and (2) approximately half the energy requirements. Another advantage is that large quantities of carbon are no longer retained by the elemental manganese. For example, the solubility of graphite in liquid manganese is about 8% (by weight) at 1500° C. The carbon, in turn, is subsequently transferred from the manganese to the aluminum as an undesirable impurity, aluminum carbide, because the latter is more stable than manganese carbide. In addition, this process has the advantage of completely replacing the carbon reduction step with a silicon reduction step. The majority of the silicon required for the manganese reduction is available from the chlorination step in the form of silicon tetrachloride, which in turn can be reduced by hydrogen to provide silicon and hydrogen chloride. Finally, the hydrogen chloride can be electrolytically decomposed to produce hydrogen and chlorine which can be recycled into the overall process.

What is claimed is:

1. A process for the production of aluminum which is devoid of aluminum-carbide products in a reactor comprising the steps of:

(a) chlorinating a material containing chemically combined aluminum and silicon with chlorine in the presence of carbon to yield aluminum trichloride and silicon tetrachloride, (b) separating the aluminum trichloride from the silicon tetrachloride, (b) separating the aluminum trichloride from the silicon tetrachloride, (c) reacting the aluminum trichloride with manganese to yield aluminum and manganese chloride, (d) reducing the silicon tetrachloride with hydrogen to yield elemental silicon and hydrogen chloride, (e) oxidizing the manganese chloride to produce manganese oxide and chlorine which is recycled to step (a), (f) reducing the manganese oxide with elemental silicon to produce manganese which is recycled to step (c), and (g) decomposing hydrogen chloride from step (d) to produce hydrogen for recycle to step (d) and chlorine for recycle to step (a).

2. The process of claim 1 wherein the chlorine is recycled for the chlorinating step.

3. The process of claim 1 wherein the silicon produced in step (d) is recycled to reduce the manganese oxide.

4. The process of claim 1 wherein the silicon tetrachloride is oxidized by oxygen to yield chlorine and silicon oxide.

5. The process of claim 4 wherein the silicon oxide is reduced by carbon to yield silicon and the oxides of carbon.

6. The process of claim 4 wherein the chlorine is recycled for the chlorinating step (a).

7. The process of claim 3 wherein the hydrogen is recycled for the silicon tetrachloride reduction step (d).

* * * * *